US012004620B2

(12) United States Patent
Selvi

(10) Patent No.: US 12,004,620 B2
(45) Date of Patent: Jun. 11, 2024

(54) ARTICLE OF LUGGAGE

(71) Applicant: IT LUGGAGE LIMITED, Hertford (GB)

(72) Inventor: Sedat Selvi, Hertford (GB)

(73) Assignee: IT Luggage Limited, Hertford (GB)

( * ) Notice: Subject to any disclaimer, the term of this patent is extended or adjusted under 35 U.S.C. 154(b) by 149 days.

(21) Appl. No.: 16/650,471

(22) PCT Filed: Sep. 28, 2018

(86) PCT No.: PCT/GB2018/052789
§ 371 (c)(1),
(2) Date: Mar. 25, 2020

(87) PCT Pub. No.: WO2019/064025
PCT Pub. Date: Apr. 4, 2019

(65) Prior Publication Data

US 2020/0237064 A1 Jul. 30, 2020

(30) Foreign Application Priority Data

Sep. 29, 2017 (GB) ..... 1715838

(51) Int. Cl.
*A45C 5/03* (2006.01)
*A45C 5/14* (2006.01)
(Continued)

(52) U.S. Cl.
CPC ..... *A45C 5/03* (2013.01); *A45C 5/14* (2013.01); *A45C 13/04* (2013.01); *A45C 13/262* (2013.01);
(Continued)

(58) Field of Classification Search
CPC .. A45C 5/03; A45C 5/14; A45C 13/04; A45C 13/262; A45C 2005/035; A45C 2013/267
(Continued)

(56) References Cited

U.S. PATENT DOCUMENTS 2,729,460 A 1/1956 Forman
2,755,896 A 7/1956 Breglia
(Continued)

FOREIGN PATENT DOCUMENTS

CN 1131447 A 9/1996
CN 1622773 A 6/2005
(Continued)

OTHER PUBLICATIONS

Seam-Definition: URL: https://www.merriam-webster.com/dictionary/seam (Year: 2021).*
(Continued)

*Primary Examiner* — Nathan J Jenness
*Assistant Examiner* — Jessica Kavini Tamil
(74) *Attorney, Agent, or Firm* — Barnes & Thornburg LLP

(57) ABSTRACT

The present disclosure provides a suitcase (100) and a method of manufacturing a suitcase. The suitcase (100) comprises a frame (160) and a fabric cover (110) for the frame (160). The fabric cover (110) is provided external to all outer edges of the frame (160), and the outer edges of the frame (160) internally tension the fabric cover (110) to locate the fabric cover (110) and to define the shape of the suitcase (100).

15 Claims, 6 Drawing Sheets

(51) Int. Cl.
*A45C 13/04* (2006.01)
*A45C 13/26* (2006.01)

(52) U.S. Cl.
CPC .. *A45C 2005/035* (2013.01); *A45C 2013/267* (2013.01)

(58) Field of Classification Search
USPC ..... 190/18 A
See application file for complete search history.

(56) References Cited

U.S. PATENT DOCUMENTS

| | | | | | |
|---|---|---|---|---|---|
| 2,964,149 | A | * | 12/1960 | Smallberg | A45C 3/001 190/18 R |
| 4,261,447 | A | | 4/1981 | Arias et al. | |
| 4,813,520 | A | | 3/1989 | Lin | |
| 5,172,795 | A | | 12/1992 | Riceman | |
| 5,181,590 | A | | 1/1993 | Carpenter et al. | |
| 5,529,156 | A | | 6/1996 | Yang | |
| 5,553,350 | A | | 9/1996 | Chang | |
| 5,607,129 | A | | 3/1997 | Kim | |
| 5,833,039 | A | | 11/1998 | Kotkins, Jr. | |
| 6,109,404 | A | | 8/2000 | Bishop | |
| 6,119,835 | A | | 9/2000 | Lin | |
| 6,131,713 | A | | 10/2000 | Sher | |
| 6,283,261 | B1 | | 9/2001 | Sher | |
| 6,315,143 | B1 | | 11/2001 | Dotts | |
| 6,964,420 | B1 | | 11/2005 | Ghanizadeh et al. | |
| 7,748,508 | B2 | | 7/2010 | Lee et al. | |
| 8,118,145 | B1 | | 2/2012 | Hamamy et al. | |
| 8,517,400 | B2 | | 8/2013 | Kim | |
| 8,662,268 | B2 | | 3/2014 | Keir | |
| 8,727,083 | B2 | | 5/2014 | Lai | |
| 9,220,326 | B2 | | 12/2015 | Selvi | |
| 9,763,503 | B2 | | 9/2017 | Selvi | |
| 10,334,926 | B2 | | 7/2019 | Selvi | |
| 2003/0057046 | A1 | | 3/2003 | Chang | |
| 2003/0213821 | A1 | | 11/2003 | Oh | |
| 2004/0007433 | A1 | | 1/2004 | Godshaw et al. | |
| 2009/0242344 | A1 | | 10/2009 | Selvi | |
| 2012/0006640 | A1 | | 1/2012 | Santy | |
| 2012/0024649 | A1 | | 2/2012 | Lai | |
| 2014/0041977 | A1 | * | 2/2014 | Chang | A45C 13/262 190/115 |
| 2016/0088915 | A1 | | 3/2016 | Selvi | |
| 2016/0206069 | A1 | * | 7/2016 | Tong | A45C 5/02 |
| 2017/0086549 | A1 | * | 3/2017 | Caputo | A45C 13/262 |
| 2017/0295898 | A1 | * | 10/2017 | Zhu | A45C 5/02 |
| 2019/0059538 | A1 | * | 2/2019 | Osnowitz | B65D 33/1658 |

FOREIGN PATENT DOCUMENTS

| | | | | | |
|---|---|---|---|---|---|
| CN | 2756078 | Y | | 2/2006 | |
| CN | 202436336 | U | | 9/2012 | |
| CN | 204232442 | U | * | 4/2015 | A45C 13/04 |
| DE | 20208648 | | | 10/2003 | |
| EP | 2787857 | B1 | | 11/2012 | |
| ES | 1019524 | | | 4/1992 | |
| ES | 1019524 | U | | 4/1992 | |
| FR | 2752207 | | | 2/1998 | |
| GB | 2361692 | | | 10/2001 | |
| GB | 2477087 | | | 7/2011 | |
| GB | 2477087 | A | | 7/2011 | |
| GB | 2552485 | A | * | 1/2018 | A45C 5/02 |
| WO | 00/13543 | | | 3/2000 | |
| WO | 03/063637 | | | 8/2003 | |
| WO | 03/102430 | | | 12/2003 | |
| WO | 2006/120509 | | | 11/2006 | |
| WO | WO2015/158143 | | | 10/2015 | |

OTHER PUBLICATIONS

PCT Search Report and Written Opinion prepared for PCT/GB2018/052789, completed Dec. 19, 2018.
Combined Search and Examination Report under Sections 17 and 18(3) for British Patent Application No. GB1715838.7 dated Dec. 21, 2017 (9 pages).
British Examination Report for British Patent Application No. GB1715838.7 dated Mar. 17, 2020 (3 pages).
Examination Report for Great Britain Patent Application No. GB1715838.7 dated Mar. 17, 2020 (3 pages).
European Search Report issued in European Patent Application No. 18782171.5 on Feb. 14, 2023; 6 pages.

* cited by examiner

ARTICLE OF LUGGAGE

CROSS-REFERENCE TO RELATED APPLICATIONS

This application is the U.S. national phase of PCT/GB2018/052789, filed on Sep. 28, 2018, which claims the benefit of United Kingdom Patent Application Number 1715838.7, filed on Sep. 29, 2017, the entire disclosures of both of which are hereby incorporated by reference herein.

FIELD OF THE DISCLOSURE

The present disclosure relates to articles of luggage. In particular, the present disclosure relates to suitcases.

BACKGROUND

Articles of luggage can come in many different shapes, sizes, and forms. In particular one known type of article of luggage is a suitcase. Typically, a suitcase may include at least one pair of wheel assemblies, and at least one or two handles. Known suitcases may be of a hard-side construction or a soft-side construction.

Hard suitcases (also known as hard-shell, hard-side or hard-construction suitcases) are typically constructed from rigid materials forming the major surfaces of the suitcase. For example, hard-side suitcases may be constructed from moulded plastic shells. The moulded plastic shells may be formed as three-dimensional shapes which, when assembled, define the major surface of the suitcase. As such, the rigid material forming of the outer surface may define the outer shape of the suitcase without the need for any other structural materials or supports.

Soft suitcases (also known as soft-shell, soft-side suitcases or soft-construction suitcases), typically include a fabric cover panels and a shape defining frame that is disposed around the periphery of one or more of the fabric cover panels. The fabric cover panels are often affixed to one another via the shape-defining frame such that the fabric cover panels substantially form the major surfaces of the suitcase.

In particular, for example, the shape-defining frame may take the form of flexible beading or piping, which is commonly used in the fabrication of soft suitcases as a means of separating and securing adjacent panels of the soft suitcase together, thereby defining the general shape of the suitcase. The adjacent edge portions of the panels are typically sewn to legs or flanges of the piping which extend beneath the outer face of the panels, leaving exposed to view only the usual outer tubular portion of the piping. Accordingly, the outer tubular portion of the piping typically sits proud of the surfaces of the suitcase thereby often defining many of the outer dimensions of the suitcase. The piping may be reinforced, such as by hard wire or coil wire inserted into the tubular portion.

In addition to piping, the shape-defining frame may also include interior metal framework combined with PE board and plywood or interior plastic frames that are bent and fixed together to form a particular shape so as to add further strength and structure to a suitcase.

Soft suitcases are usually either constructed in a "side bound" or "long bound" manner. Side bound is where whereby the piping is provided as two loops arranged in parallel either at the sides of the suitcase. Long bound is where one piping loop is provided at the rear of the suitcase on the main body and the other piping loop is provided on the front panel of the suitcase in a parallel arrangement. The loops mean that the edges defined by the loops will have a certain degree of curvature. This curvature means that the extremities of the three dimensional shape (commonly referred to as the "corners") will also have a certain amount of curvature. As the corners will be rounded, this restricts the volume inside the suitcase that may be used for packing travel items (e.g. clothes), often known as the packing capacity or volume (measured in litres).

It is an object of the disclosure to provide an alternative and improved construction of soft-side suitcases.

SUMMARY OF THE DISCLOSURE

According to a first aspect of the disclosure a suitcase is provided comprising a frame and a fabric cover for the frame. The fabric cover may be provided external to all outer edges of the frame, and the outer edges of the frame may internally tension the fabric cover to locate the fabric cover and to define the shape of the suitcase.

Preferably, the fabric cover is provided separately from the frame and is detached from the frame. In this regard, the fabric cover is located about the frame and tensioned by the frame without being fixed or attached directly to the frame. This allows a soft suitcase to be provided without the need for any piping (whether external or internal) or direct attachment to any frame elements.

By providing a suitcase whereby the cover is provided separately from the frame and detached from the frame, no fixings or attachments such as piping is required. This reduces the number of materials required to produce the suitcase. It also reduces the weight of the suitcase. Furthermore, the manufacturing and assembly process is simplified given that the cover may be constructed from a single material rather than requiring intermediary structure-providing materials such as piping or being attached to the frame.

The suitcase may comprise a shape-defining frame including a top moulded section, a bottom moulded section, and a plurality of elongate members connected between the top moulded section and the bottom moulded section. The suitcase may also comprise a fabric cover for the shape-defining frame provided external to all outer edges of the shape-defining frame. The shape-defining frame may include a top fabric cover panel, a bottom fabric cover panel, and an elongate fabric cover panel joined on a first side to the top fabric cover panel around a perimeter of the top fabric cover panel, and joined on an opposing side to the bottom fabric cover panel around a perimeter of the bottom fabric cover panel.

By providing a fabric cover for the suitcase comprising a top fabric cover panel, a bottom fabric cover panel and an elongate fabric cover panel, a cover for the suitcase may be provided with a reduced number of seams and a reduced amount of stitching when compared to traditional side bound and long bound constructions. Accordingly, the fabric cover for the suitcase may be constructed in a more economic fashion with fewer and less complex manufacturing and assembly processes. Furthermore, the fabric cover is provided external to all outer edges of the shape-defining frame. Thus, the shape-defining frame may be provided internal to the fabric cover such that the frame is not formed using any piping arrangement such as the loops provided in the traditional side bound and long bound arrangements. The absence of loops of piping means that the edges of the suitcase need not be curved and accordingly, the cover may follow the contouring of the frame. The absence of piping in general also reduces weight and the number of materials used in the construction of the suitcase. As such, a suitcase is provided with a substantially clean-lined outer profile with smooth contouring due to the absence of piping. Furthermore, the suitcase may have an increased internal volume for a given set of outer dimensions.

Preferably, the elongate fabric cover panel includes a first end joined to an opposing second end of the elongate fabric cover panel. As such, the elongate fabric cover panel may wrap around the elongate members provided between the top moulded section and the bottom moulded section. Advantageously, by providing an elongate fabric cover panel which wraps around the elongate members, a fabric cover may be provided with fewer seams, resulting in a more economic manufacturing process.

Preferably, the elongate fabric cover panel is joined to the top fabric cover panel by an inward facing seam and/or joined to the bottom fabric cover panel by an inward facing seam. As such, the fabric cover may be constructed using inward facing seams.

Advantageously, providing an elongate fabric cover constructed with inward facing seams, a suitcase may be provided with substantially flat outer surfaces. In particular, the inward facing seams of the fabric cover provide a flatter profile than piping constructions known in the prior art.

Preferably, each elongate member defines an outer edge of the shape-defining suitcase. For example, four elongate members may be provided to define four outer edges of the suitcase. As such, each elongate member, for example, four elongate members may be running from one corner of a suitcase to another corner of a suitcase. Such an arrangement may provide additional strength and stability to the suitcase.

Preferably, the shape-defining frame forms a substantially parallelepiped shape. For example, the shape-defining frame may form a substantially cuboidal shape. Advantageously, such a shape may provide a large internal volume in an efficient manner.

Preferably, the suitcase further comprises a telescopic handle. Preferably, the handle extends through the fabric cover from a support member. By providing the suitcase with a telescopic handle, a user may be more easily able to manoeuvre the suitcase. Furthermore, the telescopic handle may be easily stowed within the suitcase when the handle is not in use.

Preferably, the suitcase comprises a plurality of wheel assemblies. Each wheel assembly may be attached to the shape-defining frame through the fabric cover. For example, the suitcase may comprise two wheel assemblies or four wheel assemblies. A wheel assembly may be a cast-type wheel assembly and/or a fixed axis wheel assembly.

Preferably, the suitcase further comprises a lid formed in the elongate fabric cover panel. The lid may be configured to extend across only one major surface of the suitcase. Advantageously, by forming the lid in only one major surface of the suitcase, the lid may be provided substantially flat relative to the major surface of the suitcase when the lid is closed. By providing a relatively flat lid the internal volume of the suitcase defined by the shape-defining frame may be maximised for a given outside external dimension of the suitcase.

Preferably, the elongate members are rods.

Preferably, the top moulded section and/or the bottom moulded section include a plurality of edge-defining regions. The edge-defining regions may be configured to provide a shape-defining surface for the fabric cover. As such, the top moulded section and/or the bottom moulded section may have a three-dimensional profile in the edge-defining regions. The three-dimensional profile may be configured to define a shape of the suitcase in the edge region. By providing the top moulded section and/or the bottom moulded section with an edge defining region, the suitcase according to the first aspect may be provided with additional strength and/or rigidity.

A suitcase according to a second aspect of the disclosure may be provided comprising a shape-defining frame including a top moulded section, a bottom moulded section and a plurality of elongate members connected between the top moulded section and the bottom moulded section. The suitcase also comprises a fabric cover for the shape-defining frame provided external to all outer edges of the shape-defining frame. The fabric cover includes a first, elongated fabric panel and a second elongated fabric panel. The first elongated fabric panel is configured to extend across three surfaces of the shape-defining frame/suitcase, the surfaces being connected in a C-shaped configuration. The second elongated fabric panel also extends across three surfaces of the frame/suitcase. The first elongated fabric panel is joined to the second elongated fabric panel along their respective perimeters, such that the fabric cover encloses the shape-defining frame. Advantageously, by providing a fabric cover formed from a first elongated fabric panel and a second elongated fabric panel, a reduced and/or minimised number of seams is provided for constructing the fabric cover (i.e. compared to conventional side bound or long bond suitcases). Accordingly, a fabric cover is provided with a more economic construction.

According to a third aspect of the disclosure, a method of manufacturing a suitcase is provided. The method comprises a first step of joining plurality of a fabric cover panels together to form a fabric cover and a second step of assembling a frame inside the fabric cover. The inside of the fabric cover may be accessed through an opening in the fabric cover. The frame may be assembled such that outer edges of the frame may internally tension the fabric cover to locate the fabric cover to define the shape of the suitcase. Preferably, a fabric cover comprising fabric cover panels according to the first aspect or the second aspect may be joined together in the first step. Preferably, in the second step, the shape-defining frame of the first or second aspect may be assembled from inside the fabric cover in a single step, the inside of the fabric cover accessed through the opening in the fabric cover. The outer edges of the frame may internally tension the fabric cover to locate the fabric cover. As such, no stitching or joining of the outer cover to the frame may be required in order to manufacture the suitcase.

DESCRIPTION OF THE FIGURES

The invention may be put into practice in a number of ways and specific embodiments will now be described by way of example only and with reference to the Figures in which.

DETAILED DESCRIPTION

Figure 1:
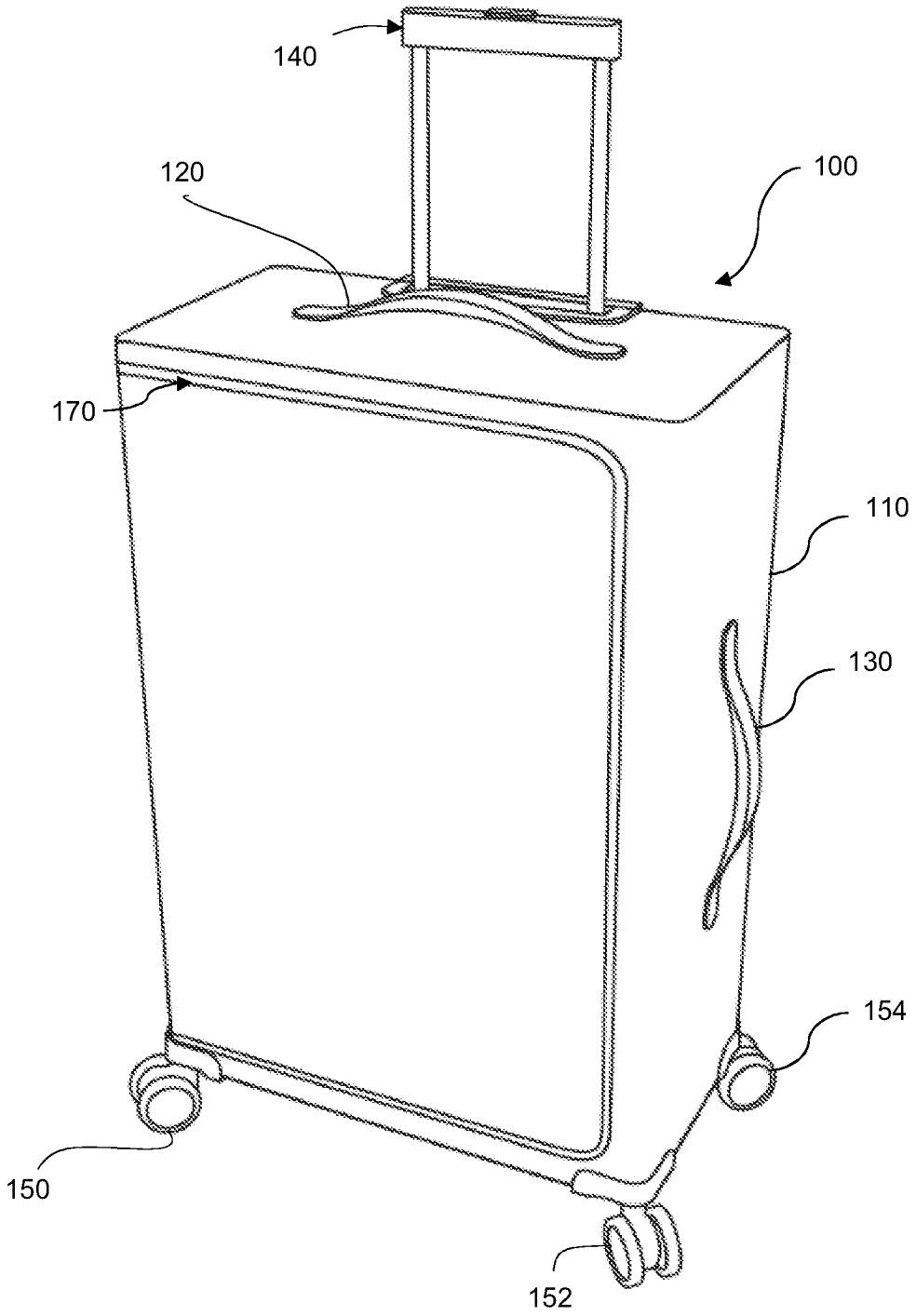
FIG. 1 is a schematic diagram of a suitcase according to a first embodiment of the disclosure.

FIG. 1 is a schematic diagram of a suitcase 100 according to a first embodiment of the disclosure. The suitcase 100 comprises an outer cover 110 and an internal shape-defining frame 160 (see FIG. 2). The frame 160 is said to be shape-defining in that its structure influences the external shape and appearance of the suitcase 100. This is because the outer cover 110 is flexible and is tensioned by the frame 160. The outer cover 110 is tensioned by the frame 160 and maintained in its position about the frame 160 without requiring any direct fixing or attachment to the frame 160, which reduces the number of assembly and/or manufacturing steps required to produce the suitcase 100. Additionally, the suitcase also includes a first carry handle 120, a second carry handle 130 and a telescopic handle assembly 140 and four castor wheel assemblies 150, 152, 154, 156.

Figure 2:
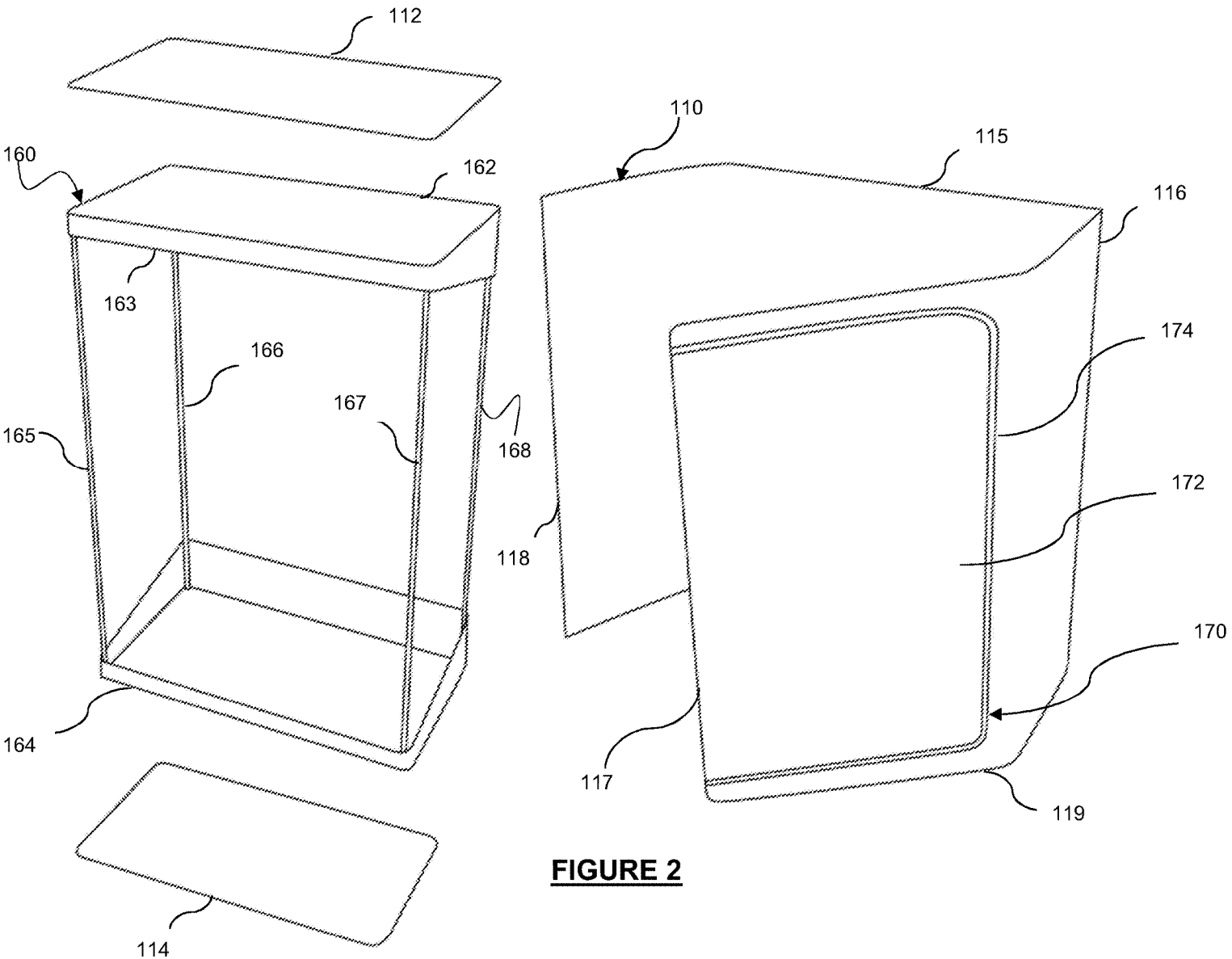
FIG. 2 shows an exploded schematic diagram of an internal shape-defining frame and a fabric cover of a suitcase according to the first embodiment of the disclosure.

FIG. 2 shows an exploded schematic diagram of the internal shape-defining frame 160 and fabric cover 110 of the suitcase 100 according to the first embodiment of the disclosure.

As shown in FIG. 2, the internal shape-defining frame 160 includes a top moulded section 162, a bottom moulded section 164 and four elongate members 165, 166, 167, 168. A telescopic handle assembly 140 (shown in FIGS. 1, 3 and 4) may be attached to the internal shape-defining frame 160. The internal shape-defining frame 160 is configured to substantially define the shape (outer shape) of the suitcase 100. As such, the internal shape-defining frame 160 is formed from a relatively rigid material (rigid construction) to define the rigid shape and/or rigid outer edges for the suitcase 100. In contrast, the fabric cover 110 is formed from a relatively flexible (soft material) such that the fabric cover 110 conforms to the shape defined by the internal shape-defining frame 160. The internal shape-defining frame 160 defines, as shown in FIG. 1, a substantially parallelepiped shape. The internal shape-defining frame 160 defines a shape including a top surface, a bottom surface, a back side surface, a front side surface, a right-hand side surface and a left-hand side surface. The skilled person appreciates that the terms top, front, back, left, right and bottom are terms considered relative to each other as viewed in FIG. 2.

The top moulded section 162 as shown in FIG. 2 defines the shape of at least the top surface of the shape-defining frame. As such, the top moulded section substantially defines the shape of at least the outer edges of the top surface of the internal shape-defining frame 160. As shown in FIG. 2 the top moulded section extends substantially across the entire area of the top surface.

The top moulded section 162 also includes edge defining regions 163. An edge defining region 163 may be provided along a length of the perimeter of the top moulded surface 162 which defines the top side surface of the internal shape-defining frame 160. As shown in FIG. 2, the edge defining region extends 163 around the entire perimeter of the top moulded surface 162 which defines the top side of the internal shape-defining frame 160. The edge defining region of the top moulded surface 162, provides a substantially L-shaped profile for the edge of the top moulded surface between the top side defined by the top moulded surface 162 and the front side surface, back side surface, right-hand side surface and left-hand side surface, of the internal shape-defining frame 160. The edge defining region 163 defines an edge shape of the internal shape-defining frame 160 which the fabric cover conforms to when the suitcase 100 is assembled. The skilled person will appreciate that other shapes of profile by also be used such as rounded profiles, chamfered profiles, protrusions or any other shape that may be formed from a moulded material.

The perimeter of the top moulded section 162 may also define corners of the suitcase on the top side surface. As such, the perimeter of the top moulded section 162 may define the two-dimensional shape of the corners on the top side surface of the suitcase 100. The corners defined by the top moulded section 162 have a rounded profile. Preferably the corners have a rounded profile with a radius of curvature of no greater than 5 mm. Advantageously, by providing corners with a radius of curvature of no greater than 5 mm, the profile of the internal shape-defining frame 160 may have abrupt corners such that the internal volume of the suitcase 100 is increased and/or maximised whilst maintaining a suitable surface over which the fabric cover may extend without causing undue stress to the fabric cover 110. In alternative embodiments, the corners may be "sharp" in that there is no visible curvature. Alternatively, the radius of curvature may take a value in a range between 3 mm and 20 mm, and preferably between 3 and 10 mm.

The top moulded section 162 is preferably constructed from moulded plastic such as a thermoplastic polymer. Preferably, the top moulded section 162 is made from polypropylene or Acrylonitrile Butadiene Styrene (ABS) although any moulded plastic may be considered that provides sufficient rigidity and strength to the suitcase frame 160, ideally whilst being a lightweight material. The top moulded section 162 defines four corners of the suitcase 100.

The bottom moulded section 164 may also be constructed from moulded plastic such as described herein for the top moulded section 162. As such, the construction of the bottom moulded section 164 may be substantially the same as the top moulded section 162. In this regard, both the top moulded section 164 and the bottom moulded section 164 may be produced from the same mould.

Alternatively, the corner profiles and/or the edge defining region of the bottom moulded section 164 may differ from the construction of the profile and edge defining regions of the top moulded section 162 in order to define the desire shape of the suitcase 100. Such variations will be readily apparent to the person skilled in the art.

The internal shape-defining frame 160 as shown in FIG. 2 comprises four elongate members 165, 166, 167, 168. Other embodiments of this disclosure may comprise a different number of elongate members, for example, other suitcases according to this disclosure may comprise at least two elongate members, at least three elongate members, at least four elongate members, at least five elongate members or at least six elongate members. As shown in FIG. 2, each elongate member 165, 166, 167, 168, may be a rod, for example, a cylindrical rod. In alternative embodiments, each elongate member may be a tubular elongate member. Each elongate member may have a cross-sectional shape that is circular or any other appropriate shape. Alternatively, each elongate member may have a cross sectional shape that comprises a right-angle at an apex of the elongate member that defines the exterior shape of the internal shape-defining frame 160. For example, each elongate member may have a cross-sectional shape that is square, rectangular, triangular or substantially L-shaped. Each elongate member 165, 166, 167, 168 may have a cross sectional shape that is constant along the length of the elongate member 165, 166, 167, 168, or may change along the length of the elongate member 165, 166, 167, 168. Each elongate member 165, 166, 167, 168, may be constructed from fibreglass, plastic or metal. Other suitable materials for constructing a relatively rigid frame known to the skilled person would be equally suitable. As such, the elongate member may be a rigid elongate member. By constructing the elongate members from rigid elongate rods the internal shape-defining frame 160 is provided in a lightweight, yet relatively strong construction. Each elongate member 165, 166, 167, 168 is connected to the top moulded section 162 at one end and is connected to the bottom moulded section 162 at an opposing end. The elongate members 165, 166, 167, 168 may each be provided in a substantially straight configuration as shown, for example, in FIG. 2. Alternatively, the elongate members may have a curved profile along their length.

Each elongate member 165, 166, 167, 168, may be connected to the top moulded section 162 or the bottom moulded section 164 by connection means. Connection means for connecting the elongate members to either the top moulded section 162 or the bottom moulded section 164 may be provided by a fastener. The fastener may be connected through the top moulded section 162 or the bottom moulded section 164 to one of the ends of the elongate member. Alternatively, the elongate member may be connected to one of the top moulded section 162 or the bottom moulded section 164 by an adhesive. Suitable adhesives for attaching the elongate members to the top moulded section 162 or the bottom moulded section 164 are known to the skilled person.

The top moulded section and/or the bottom moulded section may include at least one elongate member receiving section for receiving one end of an elongate member 165, 166, 167, 168. As such the elongate member receiving section defines a void into which one end of an elongate member 165, 166, 167, 168 may be received. For example, the receiving section may be provided as a counterbore for receiving an end of the elongate member 165, 166, 167, 168. The end of the elongate member 165, 166, 167, 168 may be secured in the elongate member receiving section of the top moulded section 162 or the bottom moulded section 164 by connection means such as a fastener or adhesive. Alternatively, the elongate member receiving section of the top moulded section 162 or bottom moulded section 164 may secure the end of the elongate member 165, 166, 167, 168 by a frictional push fit. As such the elongate member receiving section may also be connection means according to this disclosure. For example, in the embodiment shown in FIG. 2, there are four elongate members 165, 166, 167, 168, Accordingly, there are eight ends of the elongate members and thus eight separate connection means are provided for securing the elongate members 165, 166, 167, 168, to the top moulded section 162 and the bottom moulded section 164.

As shown in FIG. 2, the suitcase 100 according to the first embodiment includes a fabric cover 110. The fabric cover 110 comprises a top fabric cover panel 112 (or layer), a bottom fabric cover panel 114 (or layer), and an elongate fabric cover panel 116. As shown in FIG. 2, the top fabric cover panel 112 is configured to extend substantially across the top surface of the internal shape-defining frame 160. Accordingly, the top fabric cover panel 112 may be provided as a single piece of material such that it sits substantially flat on the top surface defined by the internal shape-defining frame 160. In this embodiment, the top fabric cover panel 112 is substantially rectangular in shape. The elongate fabric cover panel 116 is provided as a single fabric panel which extends around the four length-defining edges of the internal shape-defining frame 160. As such, the elongate fabric cover panel 116 has an elongate top edge 115 which is joined to the top fabric cover panel 112 around the perimeter of the top fabric cover panel 112. Accordingly, the fabric cover 110 covers the edges formed between the top side of the internal shape-defining frame 160 and the front side, back side, left side and right side surfaces of the internal shape-defining frame 160. In this manner two opposing ends of the elongate fabric cover panel 116 are brought together and are then secured together, for example, by stitching, to thereby create a single seam. Such a construction of a fabric cover for a soft-side suitcase is economic as the amount of stitching required is heavily reduced compared to, for example, a conventional side bound suitcase whereby the piping requires a stitching operation to be performed at either side of the piping (i.e. on each flange of the piping). Also, a single seam is provided about around the periphery of the suitcase (i.e. when stood upright) thereby providing a smooth and substantially continuous/uninterrupted contour around the suitcase.

As shown in FIG. 2, the bottom fabric cover panel 114 extends substantially across the bottom side of the internal frame. Similar to the join between the top fabric cover panel 112 and the elongate fabric cover panel 116, the elongate fabric cover panel 116 is joined to the bottom fabric cover panel 114 around the perimeter of the bottom fabric cover panel 114 via an elongate bottom edge 119. Accordingly, a join between the elongate fabric cover panel 116 and the bottom fabric cover panel 114 may be formed such that the fabric cover 110 covers which covers the edges between the bottom side surface and the front side, back side, left side and right side surfaces of the internal shape-defining frame 160. As such, the elongate fabric cover panel 116 is joined to the bottom fabric panel 114 by a single seam.

As, discussed above, the elongate fabric panel 116 is to be joined to the top fabric cover panel 112 by a single seam and the elongate fabric panel 116 is to be joined to the bottom fabric cover panel 114 by a single seam. A further vertical seam is provided by the joining of the two ends of the elongate fabric panel 116. Preferably, the fabric cover panels in the first embodiment of this disclosure are joined using stitching. Of course, other forms of joining may be equally suitable for providing the fabric cover 110 according to the first embodiment. For example, the fabric cover panels may be glued together using a suitable adhesive or the fabric cover panels may be fused together by the application of heat. The most suitable method of joining may depend upon the material used for the fabric cover 110.

The fabric cover 110 including the top fabric cover panel 112, the bottom fabric cover panel 114 and the elongate fabric cover 116 may be constructed from any fabric suitable for use in soft-sided articles of luggage. For example, the fabric cover 110 may be constructed from a nylon or a polyester material. Preferably, the fabric cover is provided by a woven material, for example, woven polyester or woven nylon. Such a material may provide the suitcase with a hard-wearing, water-resistant outer covering. Advantageously, such a covering helps protect the suitcase and its contents.

As shown in FIG. 2, the elongate fabric cover panel 116 wraps around all four elongate members of the shape-defining internal frame 160. A first end 117 of the elongate fabric cover panel 116 is joined to a second opposing end 118 of the elongate fabric cover panel when assembled. The join between the two ends of the elongate fabric cover panel 116 may be formed by any suitable method for example, stitching as discussed above. Accordingly, a fabric covering for all four major length defining sides of the suitcase may be formed form a single fabric panel. Such a construction reduces the amount of stitching and number of seams required to construct the fabric cover.

A lid (opening) 170 is formed in the elongate fabric cover panel 116. The lid 170 in the elongate fabric cover panel 116 is formed by cutting the elongate fabric cover panel 116. As shown in FIG. 2 the cut formed is substantially C-shaped or U-shaped, thereby forming a flap of material which can be joined to the suitcase by a suitable fastener 174. The lid 170 allows the suitcase 100 to be closed or opened for access to the interior volume. The fastener 174 extends along the length of the lid 170. For example, the fastener 174 may be provided as a conventional zip arrangement having two zip portions and a zip puller. Other types of fasteners known to the skilled person may be equally suitable. As such, the lid 170 for the fabric cover may be provided as part of the elongate fabric cover panel 116. Preferably, the lid 170 is formed in the elongate fabric cover panel 116 such that the lid 170 extends across only one major surface of the suitcase 100 when the suitcase 100 is assembled. Thus, the lid 170 may be provided in a substantially flat configuration that is substantially flush with the major surface of the suitcase 100 on which the lid 170 is formed. Alternatively, the lid 170 may be provided as a separate panel that is stitched to the elongate fabric cover panel 116 along the same seam as is provided between the two ends of the elongate fabric cover panel 116.

Figure 3:
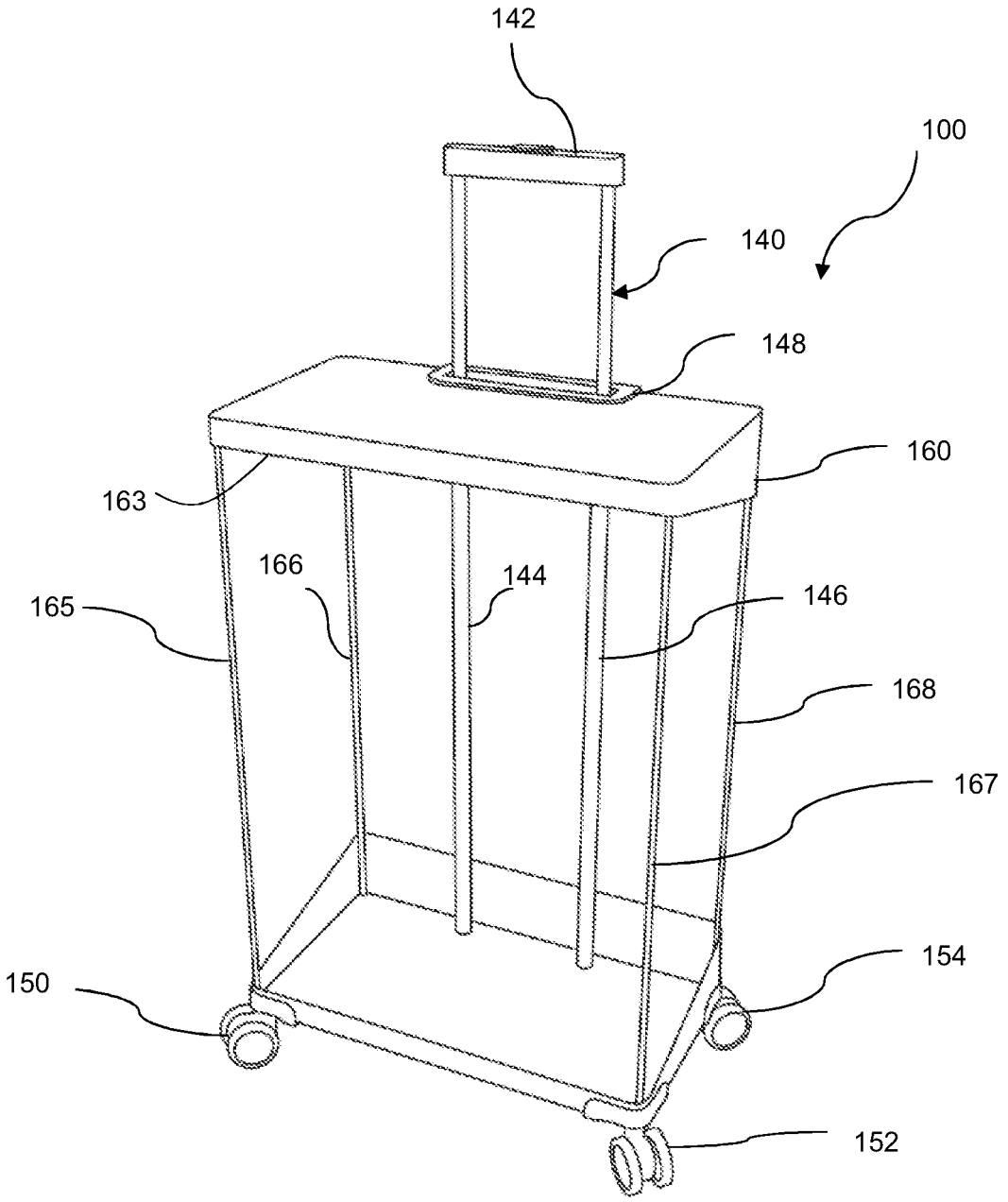
FIG. 3 shows a schematic diagram of a front view of the suitcase of the first embodiment with the outer fabric cover removed.

FIG. 3 shows a schematic diagram of a front view the suitcase 100 of the first embodiment with the outer fabric cover 110 removed. As shown in FIG. 3, the wheel assemblies 150, 152, 154, and 156 (not shown) are connected to the bottom moulded section 114 at respective corners of the bottom moulded section 114. The wheel assemblies 150, 152, 154, 156 may be connected to the bottom moulded section 114 by fasteners, for example, screws or rivets through the outer fabric cover (when assembled) and the bottom moulded section. In this regard, the wheel assemblies 150, 152, 154, 156 may act to clamp the cover 110 to the frame 160 to assist in locating and securing the cover to the frame 160. The wheel assemblies 150, 152, 154, and 156 shown in FIG. 3 are castor-type wheel assemblies. An example of a suitable wheel assembly is described in WO 2017/134467 A1.

As shown in FIG. 3, the suitcase 100 also includes a telescopic handle assembly 140, sometimes known as a "trolley handle assembly". The telescopic handle assembly 140 includes a substantially U-shaped handle portion 142 and two support members 144, 146, which are received and located by the bottom moulded section 164. The U-shaped handle portion 142 is telescopically received in the support members 144, 146 and is telescopically extendable from within the support members. It will be appreciated that the trolley handle assembly 140 may not contribute to the shape-defining aspects of the frame 160 and is therefore not considered to form a part of the shape-defining frame 160 within the meaning of the present disclosure. Other arrangements of telescopic handles are also known to the skilled person, for example, in other embodiments there may only be a single handle portion with a single telescopic tube which extends from a single support member. An example of a suitable telescopic handle assembly is described in WO 2008/09905 A1.

As shown in FIG. 3, the top moulded section may include a cutaway portion into which a handle receiving chamber insert 148 is placed. The handle receiving chamber insert 148 provides a partial housing for the U-shaped handle portion 142. The handle receiving chamber insert 148 may have a corresponding attachment portion (not shown) provided inside the suitcase 100, which enables the handle receiving chamber insert 148 to be attached securely to the top moulded section 162 of the suitcase 100. In this manner, the telescopic handle assembly 140 may act to clamp the cover 110 and may therefore assist the locating and securing of the cover 110 about the frame 160. Alternatively, the top moulded section may not include the feature of the handle receiving chamber insert 148 and instead the U-shaped handle portion may sit proud of the top outer surface of the suitcase 100.

Figure 4:
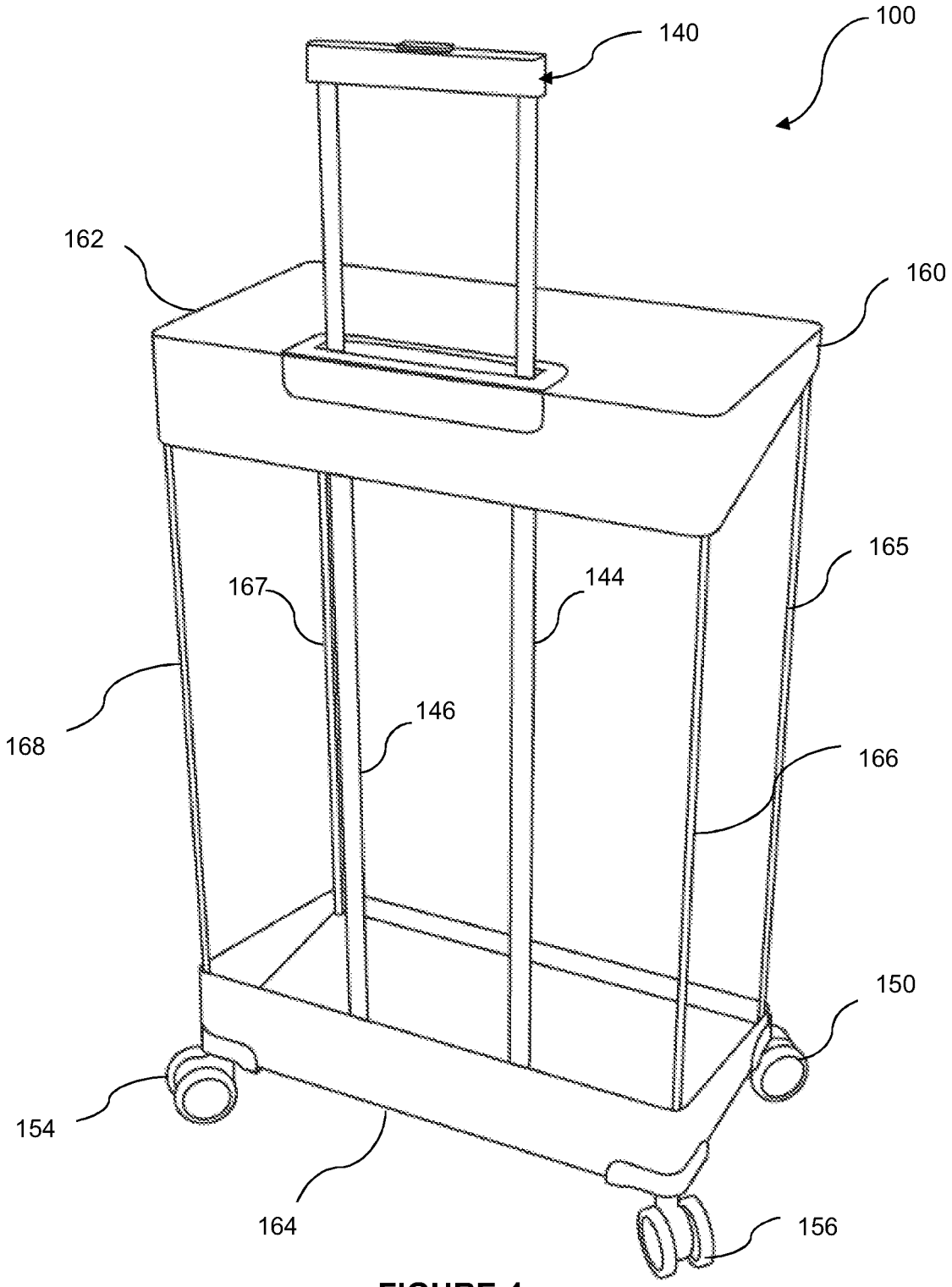
FIG. 4 shows a schematic diagram of a back side view of a suitcase according to the first embodiment of the disclosure with the outer cover removed.

FIG. 4 shows a schematic diagram of a back side view of a suitcase 100 according to the first embodiment of the disclosure with the outer cover removed.

Referring back to FIG. 1, the suitcase 100 according to the first embodiment of the disclosure may also comprise at least one carry handle 120, 130. Preferably, the suitcase 100 includes a first carry handle 120, and a second carry handle 130. Each carry handle 120, 130 may be provided on a different side surface of the suitcase 100 such that a user may carry the suitcase in a number of different orientations. The carry handles 120, 130 may be provided as an elongate strip of material which is attached to a suitcase side surface at opposing ends such that a central portion of the strip of material provides a handle. The handle may be attached to the outer cover 110, for example by stitching, an adhesive or riveting. As such, the handle may be attached to the outer fabric cover 110 prior to assembly of the suitcase. Alternatively, the handle may be attached to the suitcase 100 after the internal shape-defining frame 160 is assembled. As shown in FIG. 1, a first carry handle 120 is attached to a top side surface of the suitcase and a second carry handle 130 is attached to a right side surface of the suitcase.

Figure 5:
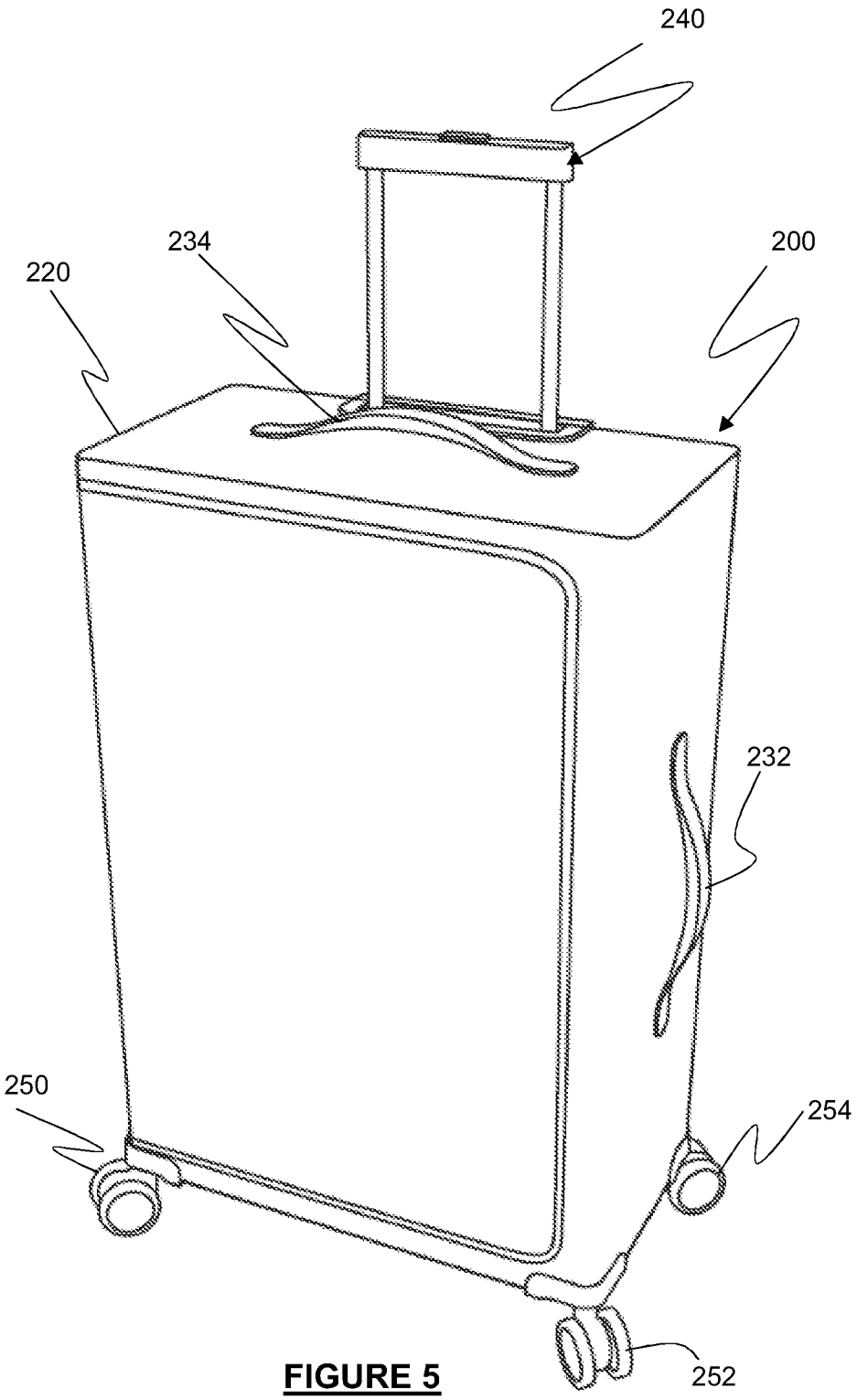
FIG. 5 shows a schematic diagram of a suitcase according to a second embodiment of the disclosure.
Figure 6:
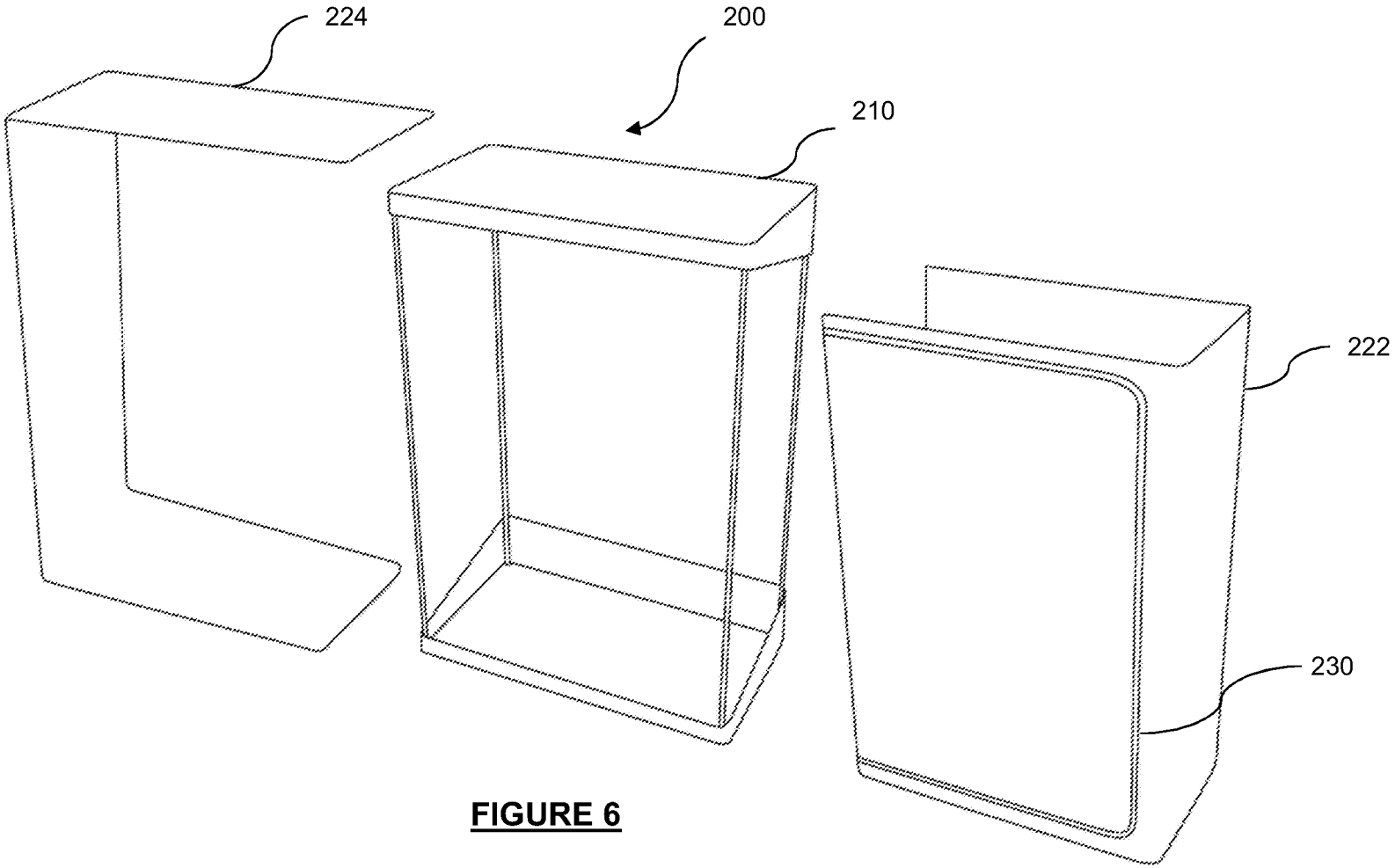
FIG. 6 shows an exploded schematic diagram of a suitcase according to a second embodiment of the disclosure.

FIGS. 5 and 6 show schematic diagrams of a suitcase 200 according to a second embodiment of the disclosure, in which an alternative fabric cover 220 is provided. In particular, whilst the first embodiment of the disclosure provided three pieces of material that may be joined together to form the cover, the second embodiment provides two pieces of material that may be joined together to form the fabric cover 220, thereby further reducing the number of seams and stitching required to form the fabric cover 220.

FIG. 5 shows a schematic diagram of a suitcase 200 according to a second embodiment of the disclosure. The suitcase 200 comprises an internal shape-defining frame 210 and a fabric cover 220. As shown in FIG. 5, the suitcase may also comprise first and second carry side handles 232, 234, a telescopic handle assembly 240, and a plurality of wheel assemblies 250, 252, 254, substantially the same as these features according to the first embodiment of the disclosure. Accordingly these features are not discussed further herein, FIG. 6 shows an exploded schematic diagram of the internal shape-defining frame 210 and the fabric cover of the suitcase 200 according to the second embodiment of the disclosure.

As shown in FIG. 6, the internal shape-defining frame 210 may be substantially the same as the internal shape-defining frame 160 according to the suitcase 100 of the first embodiment of the disclosure. Accordingly, details of the internal shape-defining frame 210 according to the second embodiment are not further described herein.

As shown in FIG. 6, the fabric cover 220 comprises a first elongated fabric panel 222 and a second elongated fabric panel 224. The fabric cover 220 may be constructed from the two fabric panels.

As shown in FIG. 6, each of the first and second elongated fabric panels 222, 224 may be configured to extend around at least three sides of the internal shape-defining frame 210 when the suitcase is assembled so as to each form a substantially C-shaped section of the fabric cover 220. The first and second elongated panels 222, 224 are joined together around their respective perimeters in order to form a complete fabric cover to house and be supported by the internal shape-defining frame 210. Accordingly, the fabric cover may be formed by joining the first elongated fabric panel 222 to the second elongated fabric panel 224 with a single continuous seam. The seam or join between the first and second elongated fabric panels 222 and 224 may be formed by stitching or gluing or any other method suitable depending on the materials used for the fabric panels. As such the method of joining the first elongated fabric panel 222 to the second elongated fabric panel 224 may be similar to the methods of joining described in relation to the first embodiment of this disclosure.

As shown in FIG. 6, the fabric cover may also include a lid 230 formed in one of the elongated fabric panels. As shown in FIG. 6, the lid 230 may be formed in the first elongated fabric panel 222 such that it is positioned in the assembled suitcase 200 extending substantially across one of the major surfaces of the suitcase 200. As such, the lid 230 may be provided in a similar fashion to the lid 170 of the first embodiment.

The skilled person will appreciate that the embodiment shown in FIG. 6 including first elongated fabric panel 222 covering substantially the front side, right-hand side and rear side surfaces of the internal shape-defining frame 210 and a second elongated fabric panel 224 covering substantially the top side, left-hand side and bottom side surfaces of the internal shape-defining frame 210 is but one possible configuration of two fabric panels. Other embodiments of this disclosure may utilise two substantially C-shaped fabric panels to cover different combinations of sides and still utilise a single continuous seam to join two said fabric panels together.

Next, a method of constructing the suitcase according to either the first embodiment or the second embodiment of this disclosure will be described.

Firstly, the outer fabric cover may be fully assembled by stitching together all respective seams of the fabric cover. As such, the fully assembled fabric cover may fully define an internal volume. As the fabric cover does not have any shape-defining frame such as piping, it is generally flexible and does not comprise any rigid structure.

Next, an opening (i.e. the lid) in the fabric cover may be used to access the internal volume defined by the fabric cover. The shape-defining internal frame 160, 210, may then be assembled inside the fabric cover through the opening provided in fabric cover. For example, the shape-defining internal frame 160, 210 may be assembled through the opening provided by the lid 170, 230. As such, the completed suitcase is assembled by constructing the internal shape-defining frame within the fabric cover via the opening. Such a method of construction allows the fabric cover 110, 220 to be constructed in a separate manufacturing step prior to the assembly complete suitcase 100, 200 including the shape-defining frame 160, 210. Such a method of construction is advantageous as it does not require any further adhesion, joining or handle stitching of the fabric cover 110, 220 to the internal shape-defining frame 167, 210. Thus, the suitcase 100, 200 may be assembled in a reduced and/or minimal number of manufacturing steps. Furthermore, as piping is not required, less stitching is needed to assemble the suitcase 100, 200, thereby further reducing and/or minimising the number of manufacturing steps.

Optionally, the fabric cover may be provided with an internal lining layer. The internal lining layer may include an opening to allow the internal frame to be assembled between the internal lining layer and the layer defined by the fabric cover. The internal lining layer may be attached to the fabric cover around the opening in order to line the internal volume of the suitcase. The lining layer may be provided as a fabric material. The internal lining layer may be attached to the fabric cover by any suitable joining method, for example by stitching or adhesive.

Accordingly, a soft suitcase, a soft-sided suitcase, or soft-type suitcase according to this disclosure is provided. The skilled person will appreciate that other articles of luggage may also be constructed according to this disclosure using a soft-type or soft-sided construction. For example, other shapes of articles of luggage may be provided with a soft-sided construction by providing an internal shape-defining frame including moulded sections connected by elongate members and a fabric cover for the shape-defining internal frame including a reduced number of seams. Thus, an article of luggage which has a soft-sided construction may be provided which is lightweight and resilient whilst still being economic to manufacture. In particular, an article of luggage with a reduced number of seams according to this disclosure may have a relatively flat profile giving the article of luggage a distinctive look and reducing the complexity of the construction of the article of luggage.

The invention claimed is:

1. A suitcase comprising:

a frame; and a fabric cover for the frame, wherein the fabric cover is provided external to all outer edges of the frame, and the outer edges of the frame internally tension the fabric cover to locate the fabric cover and to define the shape of the suitcase;

wherein the fabric cover comprises:

a top fabric cover panel;

a bottom fabric cover panel;

an elongate fabric cover panel comprising a contiguous single piece of material that extends around the frame and is stitched or adhered to itself along a vertical seam, wherein the elongate fabric cover panel has a top edge and an opposing bottom edge, wherein the top edge is joined to the top fabric cover panel by stitching or adhesive to form a first inward facing seam extending around an entire first perimeter of the top fabric cover panel and entirely around the top edge, and the bottom edge is joined to the bottom fabric cover panel by stitching or adhesive to form a second inward facing seam extending around an entire second perimeter of the bottom fabric cover panel and entirely around the bottom edge, and wherein a lid is formed in the elongate fabric cover panel, the lid configured to extend across only one major surface of the suitcase.

2. A suitcase according to claim 1, wherein the fabric cover is provided separately from the frame and is detached from the frame.

3. A suitcase according to claim 2, wherein the frame includes:

a top moulded section;

a bottom moulded section; and a plurality of elongate members connected between the top moulded section and the bottom moulded section.

4. A suitcase according to claim 3 wherein:

the vertical seam of the contiguous single piece of material of the elongate fabric cover panel includes a first end joined directly to an opposing second end of the contiguous single piece of material.

5. A suitcase according to claim 3 wherein:

each elongate member defines an outer edge of the shape-defining suitcase.

6. A suitcase according to claim 3 wherein:

the frame forms a substantially parallelepiped shape.

7. A suitcase according to claim 3 wherein:

the contiguous single piece of material of the elongate fabric cover extends around the elongate members of the frame.

8. A suitcase according to claim 3 wherein:

the elongate members are rods.

9. A suitcase according to claim 3 wherein:

the top moulded section and the bottom moulded section each include a plurality of edge defining regions configured to provide a shape defining surface for the fabric cover.

10. A suitcase according to claim 3 wherein:

the top moulded section or the bottom moulded section includes a plurality of edge defining regions configured to provide a shape defining surface for the fabric cover.

11. A suitcase according to claim 1 wherein:

the suitcase comprises a telescopic handle, the handle extending through the fabric cover from a support member that is attached to the frame.

12. A suitcase according to claim 1 further comprising:

a plurality of wheel assemblies, each wheel assembly attached to the frame through the fabric cover.

13. A suitcase according to claim 1 wherein the lid is defined by a C-shaped cut line in the elongate fabric cover panel, wherein the cut line has a first cut line portion that extends from the vertical seam in parallel relation with the first seam, a second cut line portion that extends in parallel relation with the vertical seam, and a third cut line portion that extends in parallel relation with the second seam back to the vertical seam.

14. A method of manufacturing a suitcase comprising:

a first step of joining a plurality of a fabric cover panels together to form a fabric cover;

wherein the plurality of fabric cover panels comprise:

a top fabric cover panel;

a bottom fabric cover panel; and an elongate fabric cover panel comprises a contiguous single piece of material configured to extend around a frame and stitched or adhered to itself along a vertical seam, wherein the elongate fabric cover panel has a top edge and an opposing bottom edge, wherein the contiguous single piece of material of the elongate cover panel is joined on the top edge to the top fabric cover panel by stitching or adhesive to form a first inward facing seam extending around an entire first perimeter of the top fabric cover panel and entirely around the top edge and joined on the bottom edge to the bottom fabric cover panel by stitching or adhesive to form a second inward facing seam extending around an entire second perimeter of the bottom fabric cover panel and entirely around the bottom edge;

a lid is formed in the elongate fabric cover panel, the lid configured to extend across only one major surface of the suitcase; and a second step of assembling the frame inside the fabric cover, an inside of the fabric cover accessed through the lid of the fabric cover such that outer edges of the frame internally tension the fabric cover to locate the fabric cover to define the shape of the suitcase.

15. The method according to claim 14 further comprising forming a C-shaped cut line in the elongate fabric cover panel to provide the lid of the suitcase, wherein the cut line has a first cut line portion that extends from the vertical seam in parallel relation with the first seam, a second cut line portion that extends in parallel relation with the vertical seam, and a third cut line portion that extends in parallel relation with the second seam back to the vertical seam.

* * * * *